United States Patent [19]

Thettu et al.

[11] 3,983,393

[45] Sept. 28, 1976

[54] CORONA DEVICE WITH REDUCED OZONE EMISSION

[75] Inventors: Raghulinga R. Thettu, Webster; Phillip L. Harrison, Ontario; John Stavisky, Fairport, all of N.Y.

[73] Assignee: Xerox Corporation, Stamford, Conn.

[22] Filed: June 11, 1975

[21] Appl. No.: 585,937

[52] U.S. Cl. ..... 250/326; 317/262 A

[51] Int. Cl.[2] ..... H01T 19/04

[58] Field of Search ..... 250/324, 325, 326; 317/262 A

[56] References Cited

UNITED STATES PATENTS

| | | | |
|---|---|---|---|
| 2,836,725 | 5/1958 | Vyverberg | 250/326 |
| 3,566,108 | 2/1971 | Weigl et al. | 317/262 A |
| 3,675,096 | 7/1972 | Kiess | 250/325 |

*Primary Examiner*—Alfred E. Smith
*Assistant Examiner*—T. N. Grigsby

[57] ABSTRACT

A corona generating device including an elongated corona electrode in the form of a thin wire to which a corona generating potential is applied. The wire is partially surrounded by a conductive corona shield which may be grounded. Intermediate the wire and shield and spaced apart from each are various configurations of ozone reducing members which partially surround the wire. These members are coated with a catalytic material which reacts with the ozone in an area as close as possible to the area in which it is generated, preferably in the corona glow region, and thus have been found to be more effective in reducing the ozone.

16 Claims, 9 Drawing Figures

CORONA DEVICE WITH REDUCED OZONE EMISSION

BACKGROUND OF THE INVENTION

The present invention relates to corona charging devices for depositing or altering the electrostatic charge on an adjacent surface. More particularly, it is directed to a corona charging arrangements usuable in a xerographic reproduction system for generating a flow of ions onto an adjacent imaging surface for altering or changing the electrostatic charge thereon.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, and the conditioning of the imaging surface prior, during, and after the deposition of toner thereon to improve the quality of the xerographic copy produced thereby. Both d.c. and a.c. energized corona devices are used to perform many of the above functions.

The conventional form of corona discharge device for use in reproduction systems of the above type is shown generally in U.S. Pat. No. 2,836,725 in which a conductive corona electrode in the form of an elongated wire is connected to a corona generating d.c. voltage. The wire is partially surrounded by a conductive shield having a cross section in the shape of a flat-bottomed U which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an a.c. corona generating potential is applied to the conductive wire electrode and a d.c. potential is applied to the conductive shield partially surrounding the electrode to regulate the flow of ions from gthe electrode to the surface to be charged. Other biasing arrangements are known in the prior art and will not be discussed in great detail herein.

The problem addressed by this invention is the generation of ozone by corona generators of the above noted type. Ozone is a problem firstly because of the extreme chemical activity of this gas, which, in a xerographic machine environment can attack the sensitive metal components of the corona device, rubber and polymer elements, and the toner used to develop the latent image. In addition, human exposure to ozone in high enough concentration for prolonged periods results in shortness of breath, headaches and nausea.

Future xerographic reproduction machines will be designated to operate at increased copy speeds and to provide copy of greater quality than current machine. Greater speed usually requires higher outputs from the corona devices employed in the machine and greater copy quality sometimes requires the use of additional corona generators to better condition the imaging surface and the copy paper at various stages in the xerographic process. Both of the above therefore tend to further aggravate the ozone problem.

One solution to the ozone problem is suggested in U.S. Pat. No. 3,675,096 in which the walls or housing of the corona device is coated with a material to convert the ozone formed by the corona discharge to oxygen. A foraminous screen in the path of charge travel from the corona device to the imaging surface and also coated with a catalytic material is also disclosed.

The instant application is directed to additional arrangements found to be effective in reducing ozone.

OBJECTS AND SUMMARY

It is therefore a primary object to provide an arrangement for reducing the ozone emitted by corona generating devices of the type used in xerographic reproduction machines.

A further object is to provide arrangements which may be easily added onto existing devices to decrease ozone output.

A further object is the provision of ozone reducing arrangement for corona generators which do not adversely affect the charge output of the device into which they are incorporated.

A further object is to provide an arrangement for bringing an ozone reducing coating into close proximity with the ozone generating area of the corona device without reducing charging current therefrom.

These and other objects are accomplished by means of corona generating devices including an elongated corona electrode in the form of a thin wire to which a corona generating potential is applied. The wire is partially surrounded by a conductive corona shield which may be grounded. Intermediate the wire and shield and spaced apart from each are various configurations of ozone reducing members which partially surround the wire. These members are coated with a catalytic material which reacts with the ozone in an area as close as possible to the area in which it is generated, preferably in the corona glow region, and thus has been found to more effective in reducing the ozone.

In addition, it has been found that contrary to what was expected, the corona output of devices incorporating these members has increased. Thus, for reasons as yet not completely understood, a smaller voltage is required to be applied to the corona electrode of this invention than previously required to produce the same charging current from prior art devices.

DESCRIPTION OF THE PREFERRED EMBODIMENTS

Figure 1:
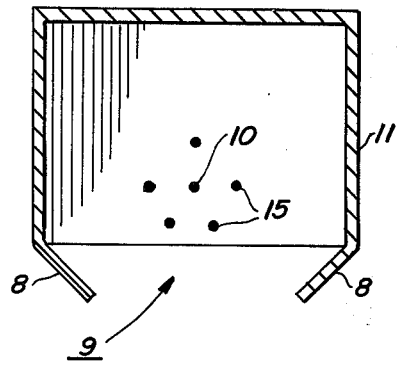
FIGS. 1–9 show specific ozone reducing members according to the invention incorporated into corona generating devices usable in xerographic reproduction machines.

Referring now to the drawings, there are shown in cross-section several arrangements of ozone reducing members for use in corona generators. The corona generators are typically incorporated into a xerographic reproduction machine in which they are suspended adjacent and spaced from an imaging surface (not shown) which is passed at a preselected velocity past the ion emitting opening in each corona generator, as is well known in the prior art. The imaging member may be a photoconductive surface of the type well known in the xerographic art which is mounted or carried on a conductive substrate (not shown).

The corona devices are each seen to comprise a corona discharge electrode in the form of an elongated wire 10. The wire 10 is partially surrounded by a shield 11 which is usually electrically grounded. The shield may, however, be biased to a potential other than ground, as is well known in the art. The shield may also be made of an insulating material or a combination of insulating and conductive materials formed in layers. The shield 11 is shown in the drawings as being of a generally cross-section in the shape of a flat-bottomed U with inwardly disposed lips 8 defining an ion or charge exit opening 9.

The exact shape of the shield, however, is not critical and any one of several commonly used shield configurations as shown in U.S. Pat. No 2,777,957 may be employed with satisfactory results.

The corona wire 10 is usually made of a conductive, corrosion resistant material 2–3.5 mils thick. U.S. Pat. No. 3,723,793 outlines a large variety of materials used as the wire electrode in corona discharge devices of the type. The wire 10 is suspended between insulating blocks (not shown) located at the ends of the channel formed in the shield in order to electrically isolate the wire from the shield. A corona generating potential is applied to the wire, while the shield is grounded or held at a reference potential. The substrate on which the imaging member is carried may also be held at a reference potential with respect to the wire and the shield, usually ground.

In order to reduce the ozone emitted from the corona device, there is provided in FIG. 1 an ozone reducing arrangement comprising an array or group 15 of wires which are coated with an ozone decomposing material which reacts with the ozone. One ozone decomposing material which was found to work satisfactorily with each of the arrangements of the invention is a mixture of metallic oxides available as "Hopcolite" from Mine Safety Appliances Corp. The main oxides in this material are magnonese oxide and copper oxide. Other catalytic material for this purpose are available commercially and may be utilized in any of the embodiments of this invention.

The wires 15 in the array may be about 0.006 inch thick but may vary considerably in thickness so long as they are not large enough to hinder the passage of charge to the imaging surface. The wires in the array shown in FIG. 1 have their centers located at the same distance from the axos of wire 10 to thereby form an open circular volume. The wires are isolated electrically from the shield, and the substrate on which the imaging surface is carried. For this purpose, they may be held in the different portions of the same insulating blocks (not shown) which hold the corona wire 10 in position.

The spacing of the catalytic arrangement from the corona wire in the arrangement of FIG. 1 and in each of the other embodiments may vary from closely adjacent the wire to closely adjacent the shield. However, a marked increase in the effect has been noted when the catalytic arrangement is within the corona glow region. This region varies as a function of various parameters including materials and applied voltage. However, as a rule of thumb, the corona region extends from the surface of the corona wire to a radial distance of 2 to 3 times the diameter of the wire. Thus, for typical corona wire diameters of 2 to 3.5 mils the corona glow region extends from approximately 4 mils to 10.5 mils from the corona wire.

The wires of the array 15 may be conductive or insulating and may be made of any one of a variety of materials so long as they serve as a suitable support for the ozone decomposing material deposited thereon. Aluminum, copper or stainless steel should perform satisfactorily, but other fibre materials may also be used.

Figure 2:
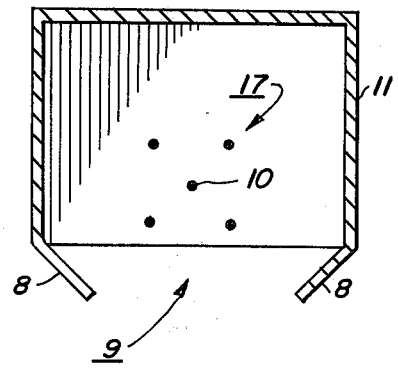

FIG. 2 shows a variation of the wire array of FIG. 1 in which the wires 17 are disposed at the four corners of an imaginary open square.

Figure 3:
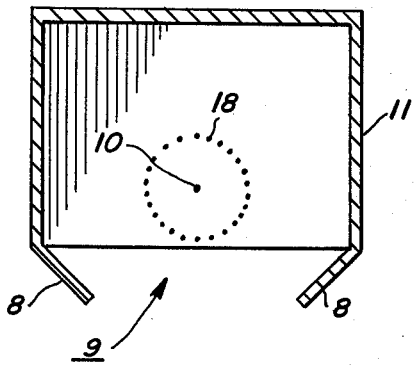

FIG. 3 is a still further variation on the general arrangement of FIGS. 1 and 2 in which the wires of the ozone decomposing array 18 form an open volume circle with each of the wires being thin and closely spaced relative to the spacing of FIGS. 1 and 2.

Figure 4:
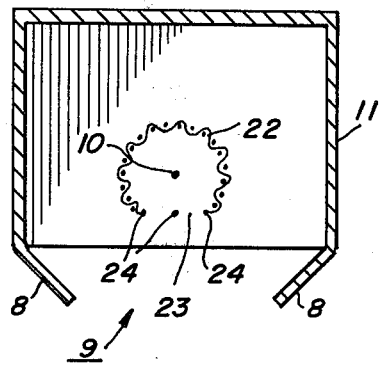

FIG. 4 shows a variation in which the ozone decomposing array is comprised of a wire mesh tube 22 which forms almost a full circular enclosure surrounding the corona glow region around the corotron wire 10. A charge emitting opening 23 is provided in the tube facing the ion discharge opening 9 in the shield 11. One, or a plurality of coated wires 24 may be placed at the mouth of the opening 23 in the tube and across the path of charge flow to the imaging surface.

Figure 5:
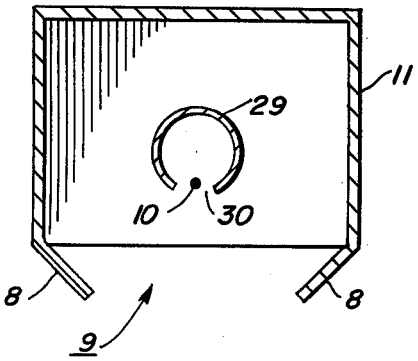

FIG. 5 shows another modification wherein the ozone decomposing member is in the shape of an arcuate shield 29 coated with ozone decomposing material as outlined hereinbefore. The arcuate shield has a section thereof removed to form a gap 30 and the corona wire is located to intersect the continuation of the shield 29 across the gap. This arrangement has been found to give especially good results since it almost totally encloses the corona glow region as disclosed above.

Figure 6:
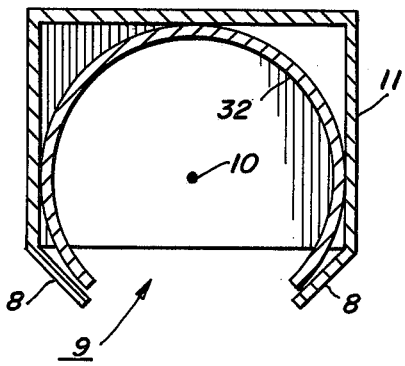

FIG. 6 shows a modification of the arrangement of FIG. 5 in which the ozone decomposing member comprises a tube 32 having an outer radius which is approximately equal to the inner width of the channel of the shield 11. The outer surface of the tube 32 is contiguous at three areas with the interior surface of the shield 11 and may be supported thereby. In this arrangement, the corona wire 10 is located approximately on the axis longitudinal of the tube 32.

Figure 7:
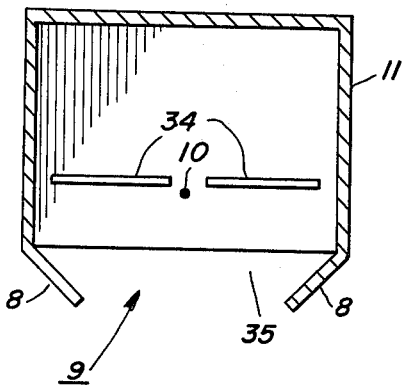
Figure 8:
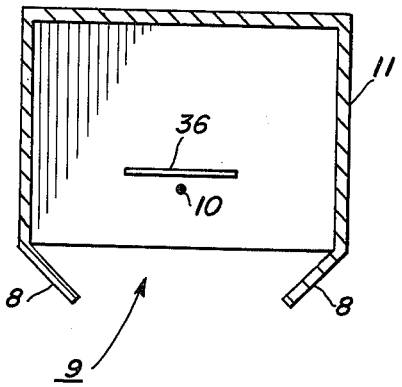
Figure 9:
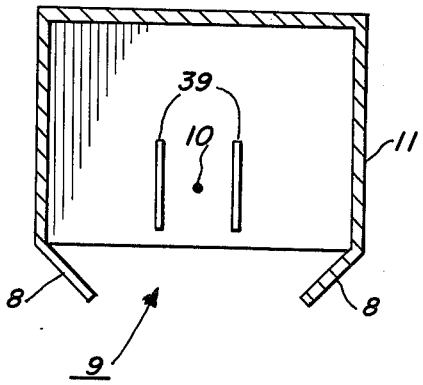

FIGS. 7–9 show variations of the invention in which the ozone reducing member is generally planar in shape. In FIG. 7 it is comprised of two planar plates 34 generally rectangular in shape which extend parallel to the wire along the length of the shield. The plates 32 are coated with ozone reducing catalytic material and spaced on opposed sides of the wire 10, with the sides having the largest surface area facing the shield ion discharge opening 9. In FIG. 8, the plates of FIG. 7 are shown joined together and located just behind the wire 10 on the side thereof opposite the shield ion opening 35.

In each of the arrangements of FIGS. 7–9, at least the sides of the plates facing the corona wire 10 are coated with ozone decomposing material of the type described hereinbefore.

FIG. 9 shows a final variation in which the planar plates 39 are rotated 90° from that shown in FIG. 7 and located to form a channel open at the top and bottom thereof. The plates 39 are again coated with ozone decomposing material and may be made of any suitable insulating or conductive material which provides an adequate base for this coating.

What is claimed is:

1. A corona discharge device with reduced ozone emitting properties comprising
an elongated wire electrode,
an elongated shield, running parallel to said wire and spaced therefrom,
electrical means for applying a corona generating potential to said wire, and
an ozone decomposing means spaced from said wire and said shield and located intermediate therebetween.

2. The combination recited in claim 1 wherein said decomposing means is electrically isolated from said shield and wire.

3. The combination recited in claim 1 wherein said means comprises a plurality of thin strands coated with an ozone decomposing material, said strands running parallel to said wire.

4. The combination recited in claim 3 wherein said strands are made of a conductive material.

5. The combination recited in claim 3 wherein said strands are metallic wires.

6. The combination recited in claim 3 wherein said strands are made of non-conductive material.

7. The combination recited in claim 5 wherein said wires defining an open volume having a circular cross section enclosing said corona wire.

8. The combination recited in claim 7 wherein said wires define an open volume having a square shaped cross section enclosing said corona wire.

9. The combination recited in claim 1 wherein said means comprises a wire mesh coated with ozone decomposing material.

10. The combination recited in claim 1 wherein said means comprises a tube substantially enclosing said wire but for an arcuate opening for permitting passage of ions from the vicinity of said wire, said tube having coated on the interior surface thereof an ozone decomposing material.

11. The combination recited in claim 10 wherein said wire is located in said opening.

12. The combination recited in claim 10 wherein said wire is located on the longitudinal axis of said tube.

13. The combination recited in claim 10 wherein said shield includes a channel running the length thereof, and said tube has a diameter only slightly smaller than the width of said channel so as to approximately tough at several areas the interior surface of said shield.

14. The combination recited in claim 1 wherein said means comprises an elongated planar surface coated on at least the side facing said wire with an ozone decomposing material.

15. The combination recited in claim 14 wherein said device is supported adjacent a chargable surface, said shield has an opening for permitting the flow of charge from the wire to said surface, said planar surface being located on the side wire opposite said surface.

16. The combination recited in claim 1 wherein said ozone decomposing means is located within the corona glow region.

* * * * *